US006119413A

United States Patent [19]

Shaw et al.

[11] Patent Number: 6,119,413

[45] Date of Patent: Sep. 19, 2000

[54] CONCRETE DECK AND BEAM SEISMIC RETROFIT SYSTEM

[76] Inventors: Lee A. Shaw, 1924 Irvine Ave., Newport Beach, Calif. 92660; Ronald D. Shaw, 1988 Pelican, Costa Mesa, Calif. 92626

[21] Appl. No.: 09/246,037

[22] Filed: Feb. 5, 1999

[51] Int. Cl.[7] ..... E04B 1/04

[52] U.S. Cl. ..... 52/167.1; 52/251; 52/252; 52/250; 52/741.1

[58] Field of Search ..... 52/167.1, 741.1, 52/251, 252, 250; 403/21, 22, 408.1

[56] References Cited

U.S. PATENT DOCUMENTS

| | | | |
|---|---|---|---|
| 1,664,827 | 4/1928 | Nicholay | 52/251 |
| 3,585,771 | 6/1971 | Pinniger | 52/251 |
| 3,782,061 | 1/1974 | Minutoli et al. | 52/125 |
| 4,282,692 | 8/1981 | Potthast | 52/236.3 |
| 4,726,163 | 2/1988 | Jacobs | 52/223 |
| 4,787,793 | 11/1988 | Harris | 411/339 |
| 5,123,220 | 6/1992 | Simenoff | 52/252 |
| 5,386,675 | 2/1995 | Baur et al. | 52/250 |

*Primary Examiner*—Carl D. Friedman
*Assistant Examiner*—Phi Dhu Tran
*Attorney, Agent, or Firm*—Stetina Brunda Garred & Brucker

[57] ABSTRACT

A method of seismically strengthening a structure having a concrete beam mechanically coupled to a concrete deck. The method comprises forming a continuous, substantially linear bore through the deck and the beam and then attaching the deck to the beam via a threaded fastener. The deck and the beam are compressed between an enlarged head and a nut of the threaded fastener. Additionally, the method comprises placing a fireproof cap on an end of the threaded fastener protruding from the nut.

8 Claims, 3 Drawing Sheets

CONCRETE DECK AND BEAM SEISMIC RETROFIT SYSTEM

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to concrete decks and beams and more particularly toward a system of seismic retrofit for mechanically connecting such decks and beams.

Currently, many buildings and particularly parking structures are built with concrete post and beam construction methods. In such methods, concrete vertical posts support horizontal concrete beams. In many instances, the posts and beams are pre-cast off site and delivered. The posts are formed with ledges that support the beams through typical concrete attachment methods. The beam may be formed with pre-stressed cables running the length thereof that add extra structural integrity and strength.

Once the beams have been secured to the posts, a concrete deck is formed over the beams through conventional concrete construction techniques. In order to mechanically connect the beam to the deck, vertical, metal studs are placed between the deck and the beam. The studs are placed within the beam either during formation of the beam or epoxied into bores formed in the beam after the beam has been fabricated. After the concrete deck sets, the deck is mechanically attached to the beam because the studs are encapsulated by the concrete deck. Such attachment creates a beam and deck system that meets current seismic safety standards.

However, over time, the deck will begin to develop stress fractures due to the movement of the beam. Specifically, when the building is a parking structure, the weight of moving vehicles will cause the pre-cast concrete beam to flex. The flexure of the beam causes stress cracks in and around the metal studs connecting the beam to the deck. Such stress cracks are undesirable because they degrade the structural integrity of the beam and deck system. When the stress cracks form around a metal stud, the mechanical attachment between the deck and the beam may not meet current seismic safety standards. Therefore, the mechanical connection between the deck and the beam must be corrected in order to meet current building codes.

The present invention addresses the problem of retrofitting existing concrete structures by providing a method of retrofit that is quick and inexpensive. The present invention provides a retrofit system for a concrete beam and deck that mechanically connects the two members together such that the structure meets current seismic safety standards.

BRIEF SUMMARY OF THE INVENTION

In accordance with the preferred embodiment of the present invention there is provided a method of seismically strengthening a structure having the concrete beam and a concrete deck mechanically coupled to each other. The method comprises forming a continuous, substantially linear bore through the deck and the beam and then attaching the beam to the deck via an externally threaded fastener.

The fastener may have a first end which defines an enlarged head and an opposed second end that is threadably engagable to a nut. Therefore, the fastener is extended through the bore wherein the head is in abutting contact with the deck and the second end protrudes from the beam. A nut is threadably attached to the second end such that the nut is in abutting contact with the beam, and the deck and beam are compressed between the enlarged head and the nut.

Furthermore, it is contemplated that a first washer is placed on the fastener before extending the fastener through the bore. The first washer will be in abutting contact with the enlarged head and the deck. Additionally, a second washer can be placed on the second end protruding from the beam before threadably attaching the nut. The second washer will be in abutting contact with the beam and the nut such that the beam and the deck is compressed between the first and the second washers. The second end of the fastener may protrude from the nut such that a cap may be threadably attached to the second end. Furthermore, it is contemplated that a counterbore is formed in the top surface of the deck in coaxial alignment with the bore such that the head of the fastener is disposed below the deck's top surface.

The continuous bore in the beam and the deck may be formed through the use of a coring device having a raisable and lowerable lift, a coring jig attached to the lift, and a drill press which is attached to the coring jig and includes a reciprocally movable drill bit. The bore is formed by positioning the coring device at a desired location within the structure such that the coring jig is aligned with the beam. Then, the lift is raised such that the beam is received into the coring jig. Next, the bore is drilled by advancing the drill bit of the drill press through the beam and the deck. Furthermore, the jig may be pivoted in order to facilitate alignment of the coring device with the beam.

In accordance with the preferred embodiment of the present invention there is provided a fastener system for seismically strengthening a structure having a concrete deck that is mechanically coupled to a concrete beam. The fastener system comprises an elongate shaft having a first end with an enlarged head engagable to a torquing tool, a second end opposed to the first end and a plurality of threads disposed on an exterior surface thereof. A nut is threadably engagable to the second end such that the nut is abutable to the beam in order to compress the deck and the beam between the enlarged head and the nut. Furthermore, the fastener system may comprise a first washer placeable between the enlarged head and the deck and a second washer placable between the nut and the beam such that the beam and the deck are compressed between the first and second washers.

The second end may further include a portion protruding from the nut when the nut is threadably engaged to the fastener. As such, the fastener system includes a threaded cap that is engagable to that portion of the second end protruding from the nut. The cap may be fabricated from a fireproof material in order to protect the fastener system. The fastener system may further be in combination with a coring device that forms the continuous bore through the beam and the deck.

BRIEF DESCRIPTION OF THE DRAWINGS

These as well as other features of the present invention, will become more apparent upon reference to the drawings wherein.

DETAILED DESCRIPTION OF THE INVENTION

Figure 1:
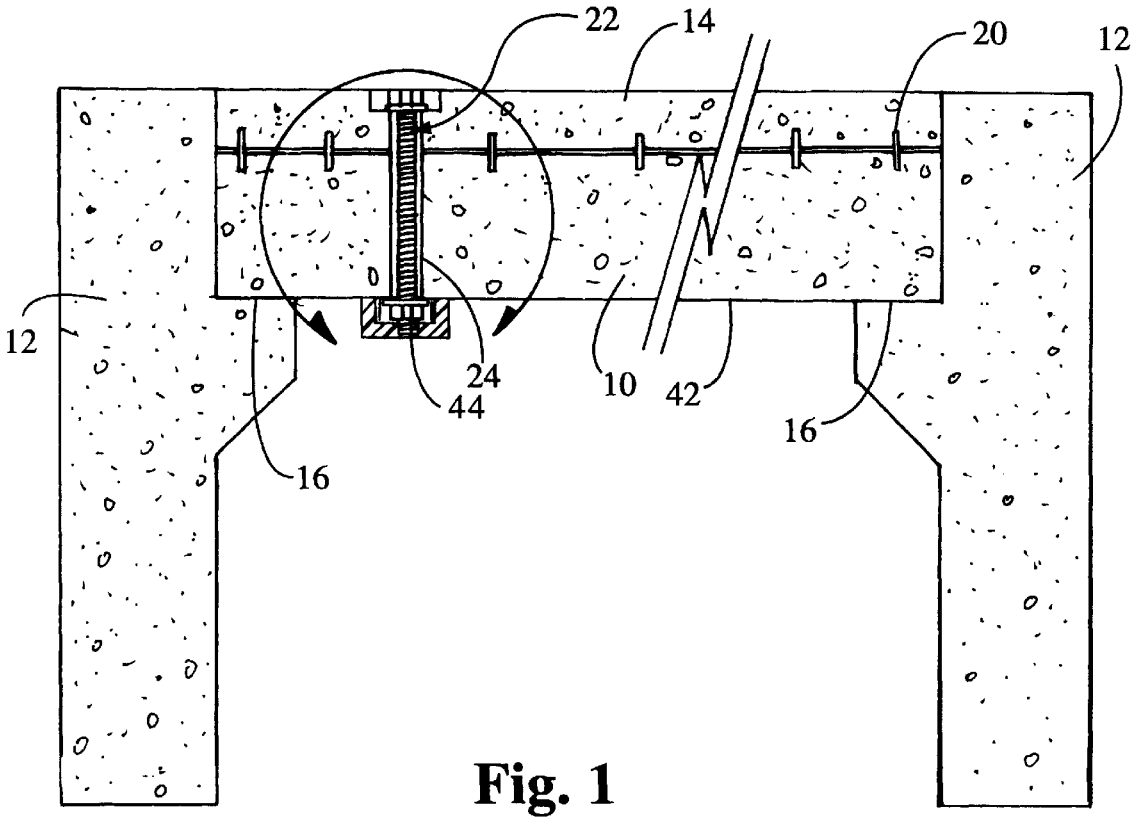
FIG. 1 is a cross-sectional view of a concrete beam and deck mechanically connected to each other through the use of the retrofit system of the present invention.
Figure 5:
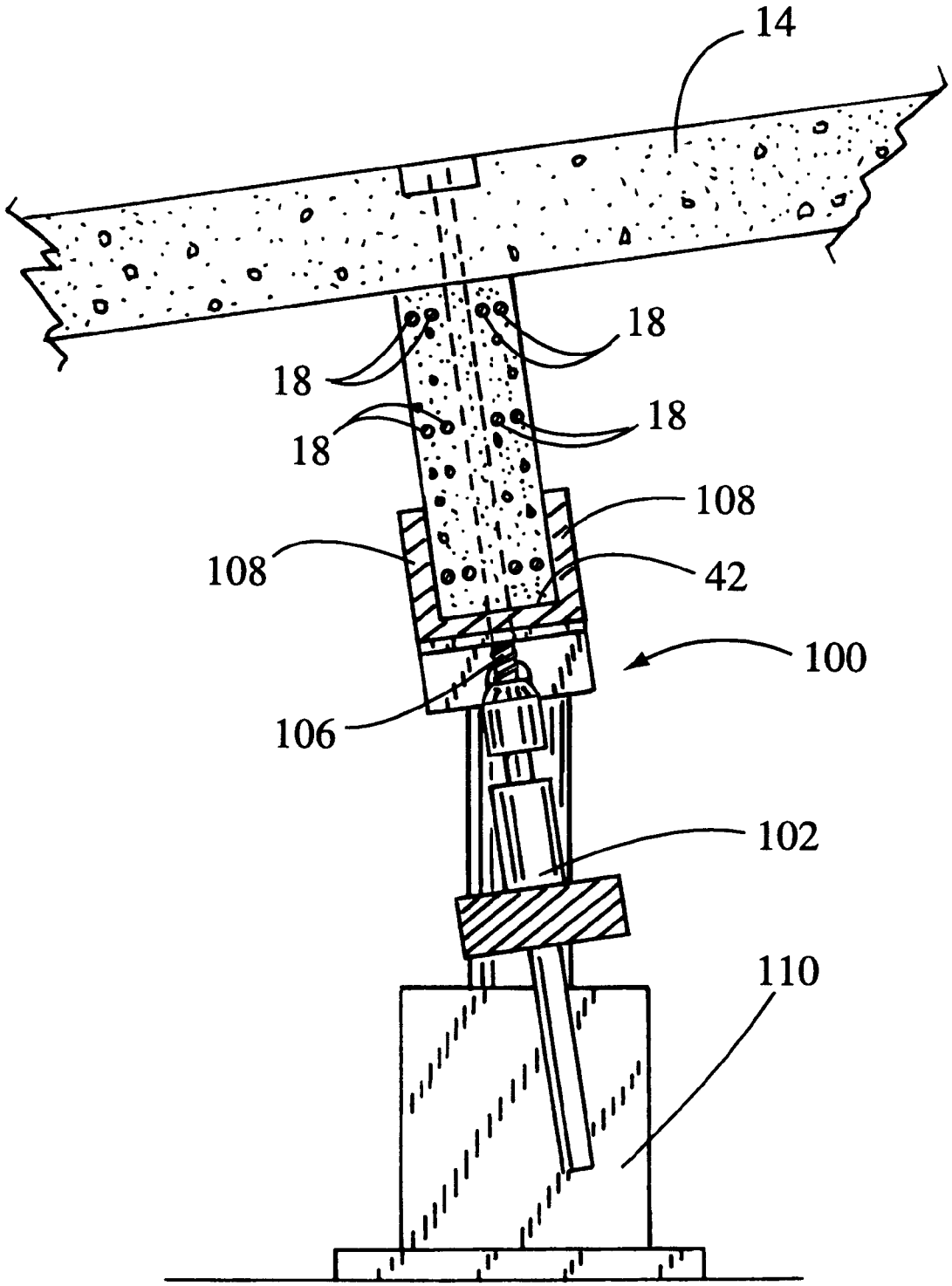
FIG. 5 is a side elevational view illustrating the manner in which the coring device shown in FIGS. 3 and 4 is used to bore a concrete beam and deck.

Referring now to the drawings wherein the showings are for purposes of illustrating a preferred embodiment of the present invention only, and not for purposes of limiting the same, FIG. 1 illustrates a concrete beam 10 supported at each end by a concrete post 12. Both concrete posts 12 are generally vertical and can be either formed on-site or pre-cast off-site and then delivered to the site. As seen in FIG. 1, each post 12 includes a ledge 16 for supporting the beam 10. The beam 10 can be attached to the ledge 16 through conventional concrete post and beam construction techniques. The concrete beam 10 is typically pre-cast off-site and, as seen in FIG. 5, comprises horizontal pre-stressed cables 18 that run the length thereof. The cables 18 are positioned within the beam 10 during fabrication such that spaces are formed between each cable 18.

As seen in FIG. 1, the beam 10 supports a generally planar, horizontal deck 14. The deck 14 is disposed adjacent to the beam 10 such that a top surface of the beam 10 is in contact with the bottom surface of deck 14. Usually, the deck 14 is poured on top of beam 10 through the use of concrete forms. The deck 14 and beam 10 may be slightly slanted from horizontal, as shown in FIG. 5, to aid in drainage of water and/or when the deck 14 is used as a ramp to higher levels in a parking structure. A plurality of metallic studs 20 mechanically join the deck 14 to the beam 10. The studs 20 are inserted into and extend from the top surface of the beam 10 such that each stud 20 is mechanically attached to the beam 10. Each stud 20 may be attached to the beam 10 either during formation of the beam 10, or by drilling a bore and epoxying each stud 20 thereinto after fabrication of beam 10. As the deck 14 is poured, each stud 20 extends into the deck 14 from the bottom surface thereof. When the deck 14 cures, each stud 20 becomes mechanically attached to the deck 14 (i.e., integrally connected).

However, as previously mentioned, the beam 10 typically flexes such that stress cracks may form around the studs 20. Such cracks, because they are around the studs 20, degrade the mechanical connection between the deck 14 and the beam 10. Therefore, the structural unity and seismic load of the overall structure is reduced. The present invention provides a system of strengthening the connection between the deck 14 and the beam 10 in order to seismically retrofit the structure.

Figure 2:
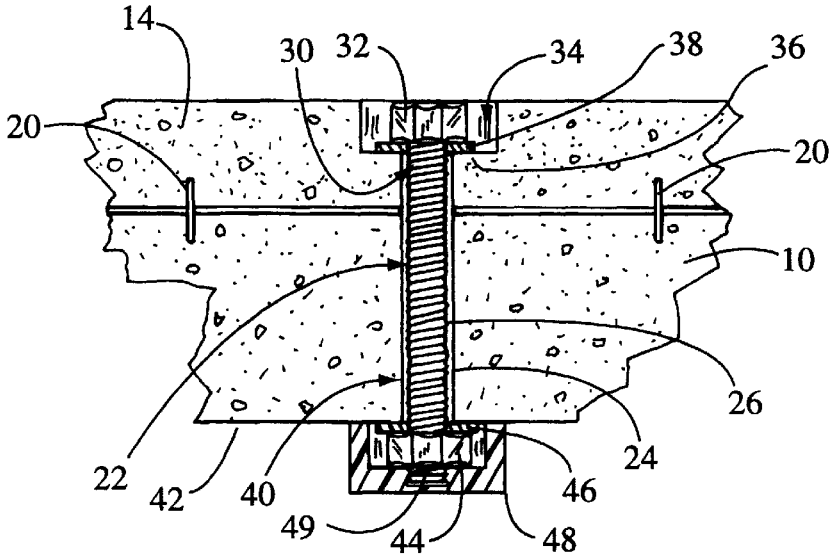
FIG. 2 is an enlarged view of the region encircled in FIG. 1.

Specifically, as seen in FIG. 2, the retrofit system of the present invention includes a threaded fastener 22 disposed within a bore 24. The bore 24 is formed such that it linearly extends through the deck 14 and the beam 10. Additionally, the bore 24 is formed such that is has a generally circular cross-sectional configuration and a diameter slightly larger than the diameter of the threaded fastener 22. As seen in FIG. 2, the threaded fastener 22 comprises a shaft 26 with threads disposed on the exterior surface thereof. The threaded fastener 22 comprises a first end 30 with an enlarged head 32 disposed thereon that is engagable to a torquing tool(not shown). Formed within the deck 14 is a counterbore or recess 34 coaxially aligned with the bore 24. The recess 34 is formed such that the head 32 of the fastener 22 is positioned below the top surface of the deck 14. Captured between the head 32 and the bottom surface 36 of the recess 34 is a first washer 38 that is compressed between the head 32 and the bottom surface 36 of recess 34.

The shaft 26 of the threaded fastener 22 extends through the bore 24 such that a second end 40 of shaft 26 projects or protrudes outwardly from the bottom surface 42 of beam 10. Therefore, as seen in FIGS. 1 and 2, a threaded nut 44 is engagable to the shaft 26 such that it can tighten down upon a second washer 46 disposed between the nut 44 and the bottom surface 42 of beam 10. By tightening the nut 44, the deck 14 and beam 10 are compressed between the head 32 and the nut 44 thereby reenforcing the mechanical connection therebetween. The threaded fastener 22 can be placed along the beam 10 in any location where stress cracks form, which is typically towards the end of the beam 10 near the posts 12. The retrofit system further includes an internally threaded cap 48 that is threadably engagable to that portion of the shaft 26 which protrudes beyond the nut 44. Therefore, the cap 48 forms a protective cover over the second end 40 of shaft 26, second washer 46, and nut 44. The cap 48 may be manufactured from a fireproof material to protect the threaded fastener 22 from fire.

As previously mentioned, the beam 10 comprises pre-stressed cables 18 running the length thereof. As such, as seen in FIG. 5, the bore 24 must be formed in a space between such cables 18 in order to avoid breaking a cable 18 and thus degrading the structural integrity of the beam 10. Therefore, the retrofit system of the present invention further comprises a coring device 100 that is used to form the bore 24 in the space between the cables 18. The coring device 100 forms the bore 24 down the center of beam 10 such that none of the cables 18 are damaged.

Figure 3:
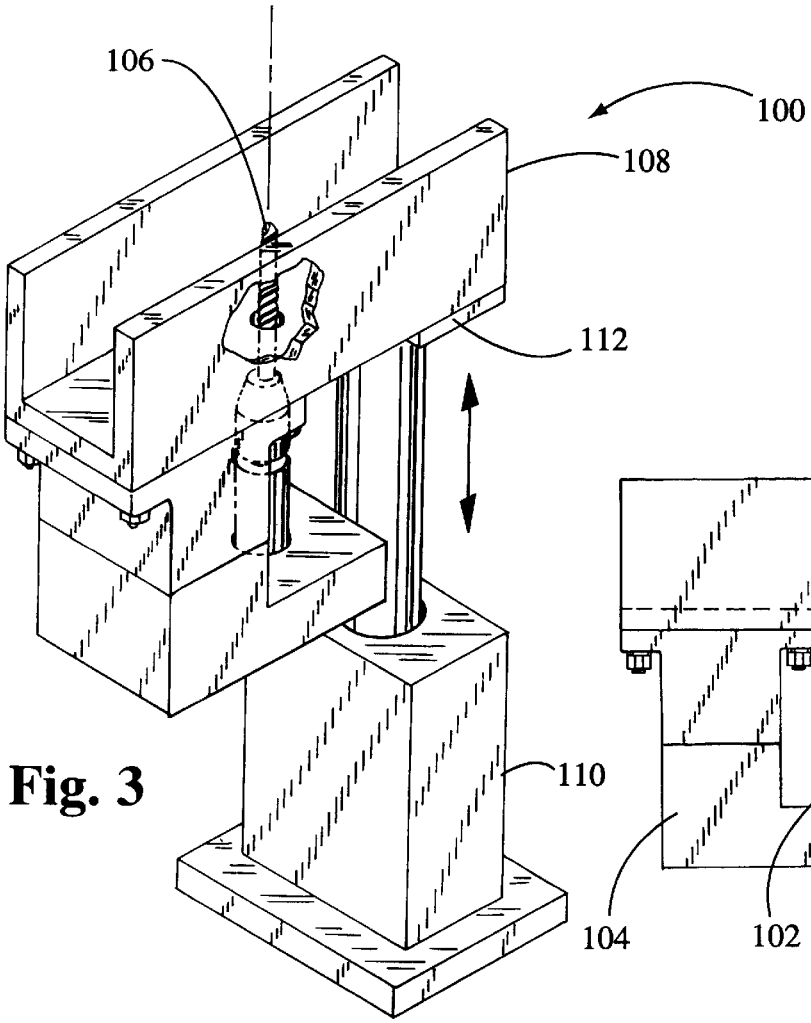
FIG. 3 is a front perspective view of a coring device of the sent retrofit system.
Figure 4:
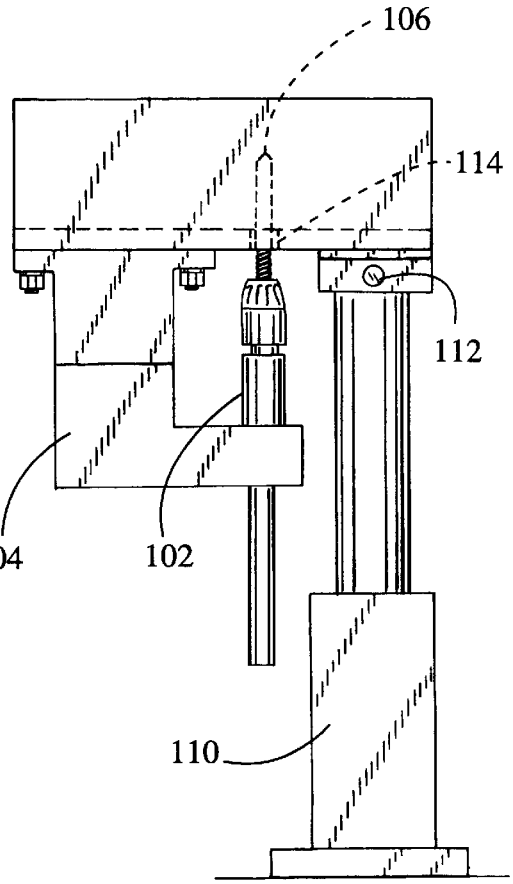
FIG. 4 is a side elevational view of the coring device shown in FIG. 3.

As seen in FIGS. 3 and 4, the coring device 100 comprises a drill press 102 mounted to a bracket 104. The drill press 102 is equipped with a reciprocally movable drill bit 106 that can create the bore 24 in concrete. The bracket 106 is attached to a coring jig 108 that aligns the drill bit 106 on the bottom surface 42 of beam 10. Therefore, as seen in FIG. 5, the coring jig 108 is formed in a generally U-shaped configuration that is complementary to the exterior shape of the beam 10 such that the jig 108 can partially receive the beam 10 in a nesting fashion. In order to position the jig 108 against the bottom surface 42 of beam 10, the jig 108 is attached to a lift 110 that can telescope the jig 108 into the proper position. The lift 110 may be hydraulically powered and portable such that it is quickly maneuvered into the proper position underneath beam 10.

As mentioned above, the beam 10 and the deck 14 may be slanted from horizontal such that the bottom surface 42 of beam 10 is not parallel with the surface on which the lift 110 will be positioned. Therefore, the lift 110 is equipped with a hinge 112 that allows the bottom of jig 108 to be rotated parallel with the bottom surface 42 of beam 10. As such, the hinge 112 may be adjustable in order to bore any beam 10 that is not parallel to the underlying surface.

In order to install the threaded fastener 22 of the present invention, the lift 110 of coring device 100 is positioned directly under the beam 10. The lift 110 is raised such that the beam 10 is nested within the jig 108. The interior surface of jig 108 is configured slightly larger than the exterior of the beam 10 such that the jig 108 can accurately align the drill bit 106. As seen in FIGS. 3 and 4, the jig 108 includes a drill bit opening 114 for the drill bit 106 to project therethrough. The opening 114 is located on jig 108 in a position whereby the drill bit 106 will not hit any of the cables 18 as it is being advanced into the beam 10. Typically, the center of the beam 10 has a space determined from architectural drawings that is free of any cable 18, as seen in FIG. 5. The drill bit 106 is advanced into beam 10 with the aid of drill press 102. The length of drill bit 106 is such that it can fully drill through the beam 10 and deck 14 thereby forming the continuous linear bore 24.

After the bore 24 is formed in beam 10 and deck 14, the coring device 100 is removed therefrom and the threaded fastener 22 is inserted into the bore 24. The fastener is tightened such that the deck 14 is mechanically connected to the beam 10 as previously discussed. Next, the fireproof cap 48 is threaded over the second end 40 of the shaft 26 in order to provide protection from fire. Finally, the recess 43 is filled with epoxy flush with the top surface of deck 14.

Additional modifications and improvements of the present invention may also be apparent to those of ordinary skill in the art such as different shapes and configurations for the threaded fastener 22. Thus, the particular combination of parts described and illustrated herein is intended to represent only certain embodiments of the present invention, and is not intended to serve as limitations of alternative devices within the spirit and scope of the invention.

What is claimed is:

1. In a structure having a concrete beam and a concrete deck mechanically coupled to each other, a method of seismically strengthening the structure comprising the steps of:

a) forming a continuous, substantially linear bore through the deck and the beam; and b) attaching the beam to the deck via an externally threaded fastener.

2. The method of claim 1 wherein the fastener has a first end which defines an enlarged head and an opposed second end, and step (b) comprises the steps of:

1) extending the fastener through the bore such that the head is in abutting contact with the deck and the second end protrudes from the beam; and 2) threadably attaching a nut to the second end such that the nut is in abutting contact with the beam, and the deck and the beam are compressed between the head and the nut.

3. The method of claim 2 wherein:

step (1) further comprises advancing a first washer over the fastener before extending the fastener through the bore such that first washer is compressed between the enlarged head and the deck; and step (2) further comprises advancing a second washer over the fastener prior to threadably attaching the nut thereto such that the second washer is compressed between the beam and the nut.

4. The method of claim 2 wherein the second end of the fastener protrudes from the nut when the nut is threadably engaged to the fastener, and step (2) further comprises threadably attaching a cap to the second end.

5. The method of claim 2 wherein the deck defines a top surface, and step (a) comprises forming a counterbore in the top surface in coaxial alignment with the bore such that the head of the fastener is disposed below the top surface.

6. The method of claim 1 wherein the bore is formed through the use of a coring device having a raisable and lowerable lift, a coring jig attached to the lift and a drill press which is attached to the coring jig and includes a reciprocally movable drill bit, and step (a) further comprises:

1) positioning the coring device at a desired location within the structure such that the coring jig is aligned with the beam;

2) raising the lift such that the beam is received into the coring jig; and 3) drilling the bore by advancing the drill bit of the drill press through the beam and the deck.

7. The method of claim 6 wherein step (1) comprises pivoting the coring jig to facilitate alignment thereof with the beam.

8. The method of claim 6 further comprising the steps of:

4) retracting the drill bit from within the deck and the beam; and 5) lowering the lift to remove the beam from within the coring jig.

* * * * *